US006275246B1

(12) United States Patent
Hasegawa et al.

(10) Patent No.: US 6,275,246 B1
(45) Date of Patent: Aug. 14, 2001

(54) THERMAL PRINTHEAD

(75) Inventors: Tsutomu Hasegawa; Hiroaki Hayashi, both of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/654,577

(22) Filed: Sep. 1, 2000

(30) Foreign Application Priority Data

Sep. 3, 1999 (JP) ..... 11-249986

(51) Int. Cl.[7] ..... B41J 2/335
(52) U.S. Cl. ..... 347/200; 347/209
(58) Field of Search ..... 347/200, 209

(56) References Cited

FOREIGN PATENT DOCUMENTS 9-183245 * 7/1997 (JP) .

* cited by examiner

*Primary Examiner*—Huan Tran
(74) *Attorney, Agent, or Firm*—Michael D. Bednarek; Shaw Pittman

(57) ABSTRACT

A thermal printhead according to the present invention includes a substrate, a plurality of heating elements formed on the substrate, at least one drive IC for driving the heating elements, and a sealing portion for sealing the drive IC. The sealing portion contains a resin material and a granular filler having an average grain size not greater than 10 $\mu$m.

16 Claims, 2 Drawing Sheets

THERMAL PRINTHEAD

BACKGROUND OF THE INVENTION

1. Technical Field of the Invention

The present invention relates to a thermal printhead for forming an image in a recording medium by heating of a heating element, and more particularly to a technology for protecting a drive IC which drives the heating element of the thermal printhead.

2. Background Art

A thermal printhead comprises a substrate, a plurality of heating elements arranged in a row on the substrate, a plurality of drive IC's for driving the heating elements, and a sealing portion for sealing the drive IC's.

Each of the heating elements is formed by electrically dividing a heating resistor formed along an edge of the substrate. The drive IC's is mounted on the substrate and are mutually connected via a predetermined wiring formed on the substrate and a plurality of wires. Each of the drive IC's has a predetermined number of the heating elements allocated, and each of the drive IC's selects a heated state or a non-heated state for each of the heating elements allocated thereto. Therefore, by having each of the drive IC's drive to heat selected heating elements, an image is outputted in a recording medium which is being transferred on the heating elements.

The sealing portion is made of resin, and is formed on the substrate to cover the drive IC's and the accompanying wires. Purposes of providing the sealing portion include to protect the drive IC's and the wires from external forces, to insulate the drive IC's and the wires from moisture and chlorine attacks, and to shield from external light. Therefore, the sealing portion must be high not only in terms of strength and moisture resistance but also in terms of light shielding. In order to meet these requirements, the sealing portion is formed by pouring and setting a resin component such as an epoxy resin, containing a black pigment such as carbon black, and/or a filler such as silica, depending on a condition.

A thermosetting resin, such as the epoxy resin, attains a high level of hardness once becoming solid. The hardness increases if the filler is added. Further, the addition of the filler reduces shrinkage of the thermosetting resin at the time of hardening. However, a large amount of filler added will make the thermosetting resin brittle, decreasing the ability to protect the drive IC's and the wires from external forces. In view of the brittleness, the amount of the filler to be added to the thermosetting resin for the sealing portion must be limited within a certain range, which means that the shrinkage of the thermosetting resin to or beyond a certain extent must be accepted. As a result, components directly contacting the thermosetting resin, including the drive IC's, wires, substrate surface and the wiring formed on the substrate, comes under a substantial stress caused by a shrinking force exerted when the thermosetting resin hardens. Further, since the thermosetting resin sets as shrunken, the stress acting on the drive IC's and other components will remain un-released within the formed sealing portion.

If the filler added to the sealing portion has a large average grain size, it is more likely that the filler grains are pressed onto the drive IC's and other components, and at a greater force. Conventionally, the filler having a relatively large average grain size of about 15 $\mu$m is used in the sealing portion, and this leads to a problem of damage in the drive IC's and wirings caused by the residual stress.

The damage to the drive IC's and the wiring may be avoided if the conventionally used filler, having a relatively large grain size, is thermally melted to round sharp edges of the filler grains. However, even with this operation, because of the large average size of the filler grains, the filler grains can be split or cracked by the shrinking force or the residual stress of the thermosetting resin to have sharp edges again. This problem is more serious in such a filler as silica which is a material susceptible to splitting and cracking. If the phenomenon described as above develops, it becomes impossible to properly avoid damage to the drive IC's, wirings and so on caused by the residual stress in the sealing portion.

DISCLOSURE OF THE INVENTION

It is therefore an object of the present invention to eliminate or reduce the above described problems.

According to a first aspect of the present invention, a thermal printhead is provided. The thermal printhead comprises a substrate, a plurality of heating elements formed on the substrate, at least one drive IC for driving the heating elements, and a sealing portion for sealing the drive IC. The sealing portion of the thermal printhead contains a resin material and a granular filler having an average grain size of not greater than 10 $\mu$m.

Preferably, the average grain size of the granular filler is not greater than 5 $\mu$m.

Preferably, the grains of the filler are rounded by such treatment as a thermal treatment and a chemical treatment. For example, if a granular silica is used as the granular filler, sharp corners of the filler can be rounded by a heating treatment at 1650° C.–2000° C., or a chemical treatment utilizing hydrofluoric acid, hot alkali and so on.

As has been described earlier, conventionally, the filler used in the sealing portion of the thermal printhead has an average grain size of about 15 $\mu$m. Therefore, if the resin material includes a resin component which shrinks relatively significantly when hardens for example, the drive IC's and the wiring are damaged sometimes, due to the big average size of the filler grains. On the contrary, according to the first aspect of the present invention, the sealing portion of the thermal printhead is made of a material mixed with the filler having an average grain size of not greater than 10 $\mu$m. When a resin component containing a filler dispersed within is hardened, stress generated at the time of hardening acts on each of the filler grains, and the amount of the stress acting on the filler becomes greater when the average grain size is greater. Therefore, in the sealing portion according to the present invention, which uses the filler having an average grain size smaller than convention, the stress acting on each of the filler grains is smaller than in the convention. Thus, if the filler having a smaller average grain size is used, probability for the filler to be pressed onto the drive IC's and other components decreases even if the amount of shrinkage is large at the time of hardening. Further, even if the filler is pressed onto the drive IC's and so on, the pressing force is small. Thus, according to the sealing portion using the filler having a small average grain size of not greater than 10 $\mu$m, the damage to the drive IC's and accompanying wiring can be appropriately avoided, and as a result, the drive IC's are effectively protected.

Preferably, the filler is selected from the group consisting of silica, alumina, zinc oxide, calcium carbonate, glass, kaolin, and clay.

Preferably, the resin material comprises a thermosetting resin.

Preferably, the thermosetting resin is selected from the group consisting of epoxy resin, polyimide resin, melamine resin, silicone resin, and phenolic resin.

Preferably, the resin material further contains a hardening agent such as carboxylic acid anhydride, aliphatic polyamine, and aromatic polyamine.

Preferably, the resin material includes a photo-setting resin such as benzophenone, and benzoin ether.

A second aspect of the present invention provides a method of sealing a drive IC with resin. The method comprises a mixing step for preparing a composite resin material by mixing a granular filler having an average grain size of not greater than 10 $\mu$m with a resin material; an applying step for applying the composite resin material onto a substrate of a thermal printhead so as to cover a drive IC mounted on the substrate; and a hardening step for hardening the composite resin material by heating.

Preferably, the grains of the filler are rounded by a heating treatment or a chemical treatment performed before the mixing step.

The mixing step utilizes a mortar-type mixing machine for dispersing the filler.

An average grain size of the filler is not greater than 5 $\mu$m.

The filler is selected from the group consisting of silica, alumina, zinc oxide, calcium carbonate, glass, kaolin, and clay.

The resin material includes a thermosetting resin, and the resin material is selected from the group consisting of epoxy resin, polyimide resin, melamine resin, silicone resin, and phenolic resin.

Other characteristics and advantages of the present invention will become clearer from the following detailed description to be made hereinafter.

BEST MODE OF CARRYING OUT THE INVENTION

A preferred embodiment of the present invention will be specifically described with reference to the accompanying drawings.

Figure 1:
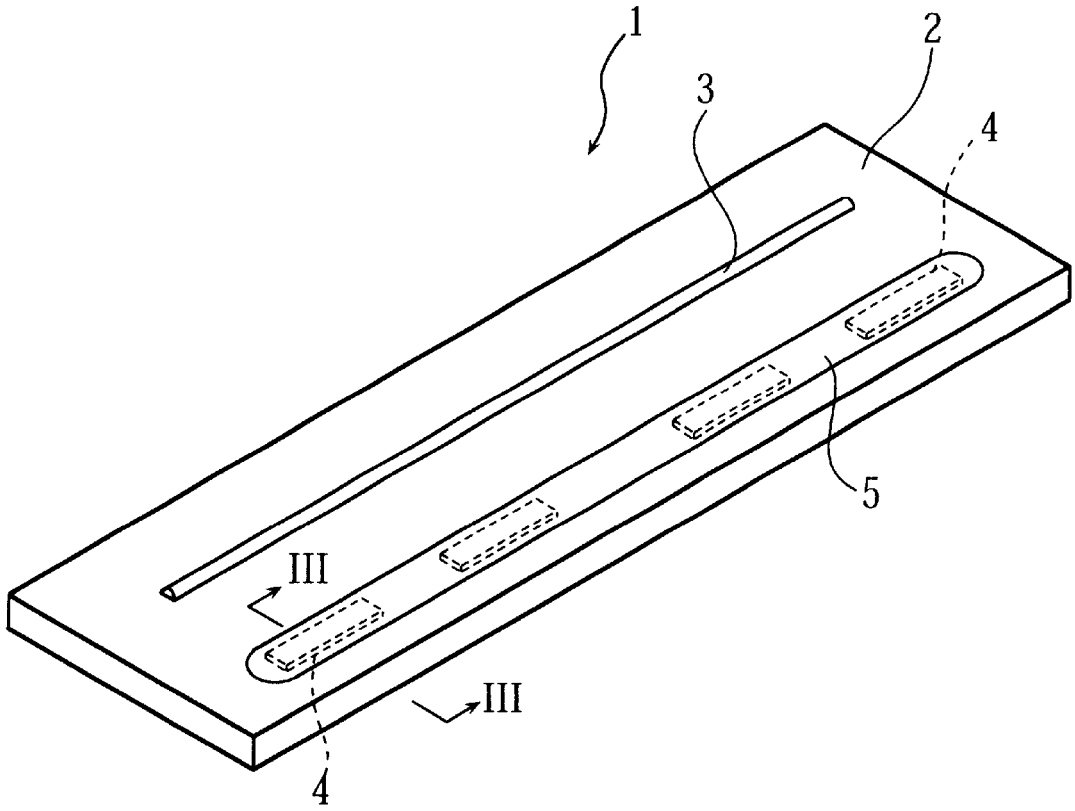
FIG. 1 is a perspective view showing a thermal printhead as an embodiment of the present invention.

FIG. 1 shows a thermal printhead 1 as an embodiment of the present invention. The thermal printhead 1 comprises a rectangular substrate 2, a heating resistor 3 formed along a longitudinal edge of the substrate 2, four drive IC's 4 formed along the other longitudinal edge, and a sealing portion 5 provided to cover these drive IC's 4. The substrate 2 is made of a ceramic material for example. The heating element 3 is formed for example by baking a thick film of a resistor paste formed by using a screen-printing method. The drive IC's are, as will be described later, to heat heating resistor elements formed in the heating resistor 3, and are mutually connected via a wiring pattern and wires (not illustrated in FIG. 1). The sealing portion is made of a resin, and is formed to cover not only the drive IC's but also part of the wiring and wires accompanying the drive IC's.

Figure 2:
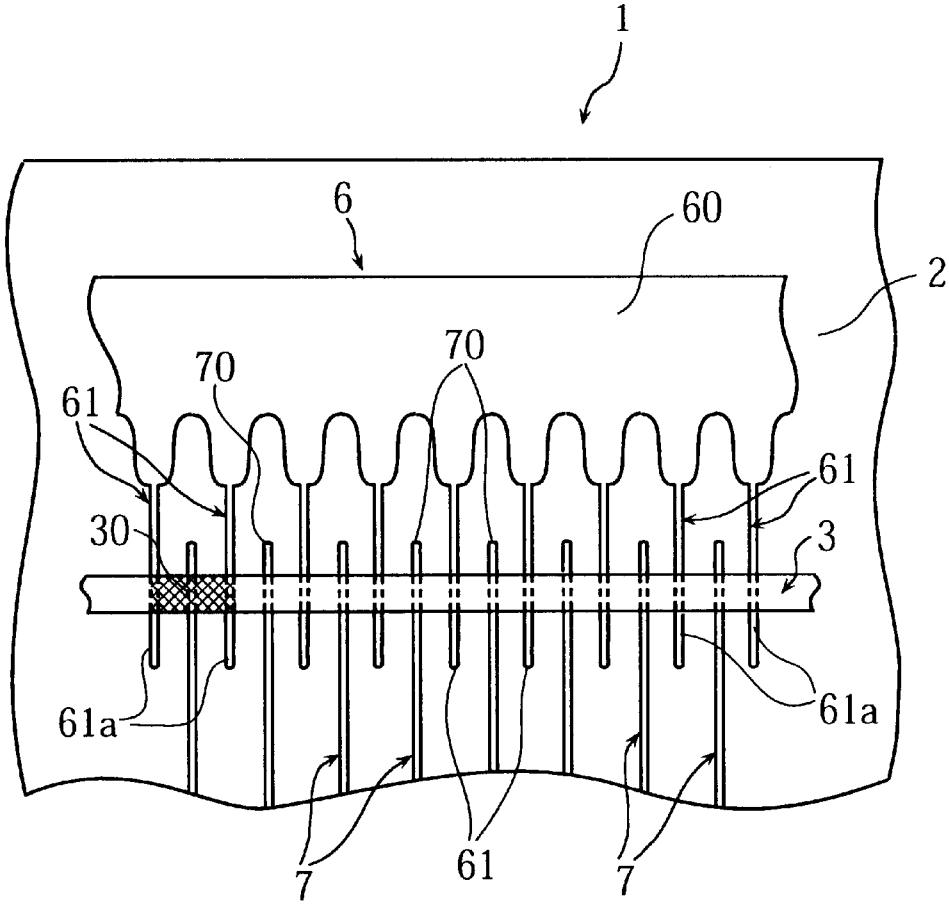
FIG. 2 is an enlarged plan view of a portion of the thermal printhead in FIG. 1.

FIG. 2 is an enlarged view of a portion of the thermal printhead in FIG. 1. As shown in FIG. 2, the heating resistor 3 is electrically divided by a common electrode 6 and a plurality of individual electrodes 7. The common electrode 6 includes a common line 60 and a plurality of comb-teeth portions 61. The common line 60 extends longitudinally of the substrate 2, generally in parallel to the heating resistor element 3. The comb-teeth portions 61 project out of the common line 60 widthwise of the substrate 2, being spaced from each other at a predetermined interval. Each of the comb-teeth portions has a tip portion 61*a*. The tip portion 61*a* lies under the heating resistor element 3, or in other words, partially sandwiched by the heating resistor element 3 and the substrate 2. On the other hand, each of the individual electrodes 7 has an end portion 70. The end portion 70 also passes under the heating resistor element 3. With the above arrangement, the heating resistor element 3 is electrically divided by the comb-teeth portions 61 of the common electrode 6 and the plurality of the individual electrodes 7, with each portion of the heating resistor element 3 sandwiched by a mutually adjacent pair of comb-teeth portions thereby constituting a heating element 30.

When an image is outputted, the heating element 30 is driven to be heated by one of the drive IC's as follows: In accordance with a signal inputted via the wiring 8 and a wire W connected thereto, the drive IC 4 applies electric current to a selected individual electrode 7. Then, the current flows from the individual electrode 7 to a pair of the comb-teeth portions sandwiching the individual electrode 7. As a result, the portion of the heating resistor electrode 3 passed by the current heats up as one heating element 30.

Figure 3:
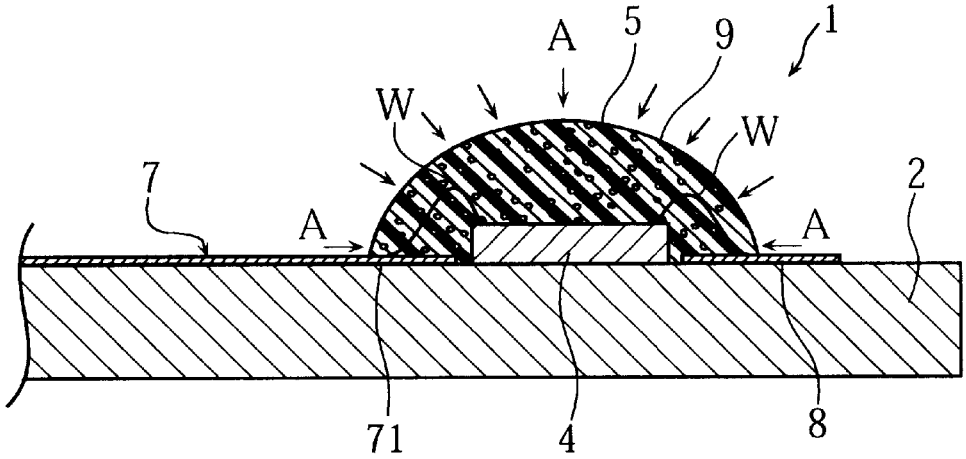
FIG. 3 is a sectional view of the thermal printhead in FIG. 1 taken in lines III—III.

FIG. 3 is a sectional view of the thermal printhead in FIG. 1 taken in lines III—III. As shown in FIG. 3, each of the individual electrodes 7 further has another end portion 71. The other end portion 71 extends close to the drive IC 4. The other end portion 71 is electrically connected to a predetermined terminal pad (not illustrated) formed in a predetermined one of the drive IC's. Each of the drive IC's is electrically connected, via the wire W, to the wiring 8 through which electric power is supplied to the drive IC 4 and input/output of the signal is performed. The wiring 8 is connected to a connector (not illustrated) provided in the substrate 2. Through this connector, each of the drive IC's is supplied with the power and input/output signals.

As shown in FIG. 1 or FIG. 3, the sealing portion 5 includes filler 9, and is formed on the substrate so as to cover each of the drive IC's 4 and the accompanying wires W. The sealing portion 5 is provided in order to protect the drive IC's 4 and the wires W from external forces, to avoid adverse affect to the drive IC's 4 and the wires W caused by chlorine and moisture, and to eliminate adverse affect of external light. The sealing portion 5 as described above is formed as follows for example.

Specifically, the filler 9 is added to a resin material which contains a resin component, a black pigment, and a hardening agent if necessary. Further, the resin material is mixed with a solvent so that the resin material has an appropriate viscosity. The prepared resin material is applied onto the substrate to cover each of the drive IC's and the wires W, and then is heated to allow the solvent to vaporize and the resin component to set.

According to the present embodiment, the resin component is an epoxy resin. In order to achieve the above described objectives of the sealing portion, the epoxy resin is preferable in consideration of the strength and resistance to moisture. Further, a phenol resin is used as the hardening agent for the epoxy resin. The hardening agent may be selected depending on the kind of resin to harden, hardness (cross linking ability) of the resin to be achieved, hardening speed and so on. Further, in addition to the hardening agent, a hardening promoter such as tertiary aromatic amine, and a latent hardening agent may also be added.

According to the present embodiment, carbon black having an average grain size of 0.1–1 μm is used as the black pigment, granular silica having an average grain diameter not greater than 10 μm is used as the filler 9, and diethylene glycol or diethyl ether is used as the solvent.

The filler 9 is made granular by milling and classifying for example, row material silica. Before being added to the resin material, a heat treatment at a temperature of 1650–2000 ° C. or a chemical treatment using hydrofluoric acid, hot alkali and so on, in order to round sharp edges of the silica grains. If such a treatment as above is performed, damage to the drive IC's 4 and the wires W can be reduced even if the filler 9 contained in the resin material or the sealing portion is pressed against the IC's and wires W during and after the thermal setting.

Mixing of the filler 9 with the resin material is suitably performed by using a dispersing method utilizing a mortar-type mixing machine. In the dispersing method using the mortar-type mixing machine, the resin material and the filler are placed in a container functioning as a grinding bowl and is mixed uniformly by a mixing roller functioning as a grinding rod. Further, according to the present method using the mortar-type mixing machine, the filler 9 is not very much subject to crashing kinds of forces, differing from a roller dispersing method in which a pair of rollers rotating in reverse directions from each other provides shearing force. Therefore, during the mixing process, the chipping and breakage of the filler 9 is appropriately avoided. As has been described, the formation of the sharp edges in the filler 9 can be appropriately avoided by the dispersing method using the mortar-type mixing machine when mixing the filler 9 with the resin component, and therefore, it becomes possible to effectively avoid the damage to the drive IC's 4 and the wiring 8.

The resin material before being set contains the resin component at a rate of 100 by weight, the hardening agent at a rate of 150–200 by weight, the black pigment at a rate of 1–20 by weight, the filler at a rate of 750–900 by weight, and the solvent at a rate of 100–200 by weight.

As has been described earlier, the shrinking force (shown by arrow A in FIG. 3) at the time when the thermosetting resin hardens exerts substantial stress to the drive IC's, the wire W, the surface of substrate 2, and the wiring 8 formed on the surface of the substrate. In addition, since the thermosetting resin hardens as shrunken, the drive IC's and other components become under a residual stress when the sealing portion is formed. However, according to the present embodiment, silica, for example, having a small average grain size of not greater than 10 μm is used as the filler 9. Thus, even if there is the stress at the time of shrinking or the residual stress after the hardening, it is less likely and to a less extent that the filler is pressed against the drive IC's or the wiring8. As a result, the damage to the drive IC's and the wiring 8 is eliminated or reduced.

INVENTIVE EXAMPLE 1

In this inventive example, the sealing portion was formed on the substrate so as to cover each of the plural IC's mounted on the substrate. This sealing portion was removed from the substrate, and then the number of scratches formed on the drive IC's was counted.

Specifically, first, six drive IC's each having a surface area of 5.27×1.45 mm were mounted, with a 0.25 mm spacing in between, on the substrate of a ceramic having a rectangular shape (6.4×1.4 cm). Next, the sealing portion weighing 0.7 g was formed to have a width of 6.25 mm and a length of 56 mm so as to cover these drive IC's. This sealing portion was formed by the following method: First, the mixture containing ingredients listed in Table 1 was ground and mixed by the mortar-type mixing machine to prepare a paste of resin in which the filler is dispersed. The filler was granular silica having an average grain size of 10 μm. The paste was applied onto the substrate to cover the six drive IC's mounted on the substrate, and then baked at 110° C. for 30 minutes, and further at 150° C. for 120 minutes, thereby hardening the resin components contained in the paste to form the sealing portion.

The sealing portion thus formed was dissolved by using a 0.94 mol/l nitric acid, and was removed from the substrate. Each of the drive IC's was further cleansed in an aluminum etching solution. The aluminum etching solution was a mixture of phosphoric acid, acetic acid, nitric acid, and pure water mixed at a respective mole ratio of 75:15:3:2. Next, the number of scratches on surfaces of each drive IC was observed by using a scanning electron microscope. The result is summarized in Table 2.

TABLE 1

| Composition | | |
|---|---|---|
| Components | | Amount (rate by weight) |
| Resin Component | Epoxy Resin | 100 |
| Hardening Agent | Phenolic Resin | 180 |
| Filler | Silica ($SiO_2$) | 800 |
| Dye | Carbon Black | 10 |
| Solvent | Diethylene Glycol | 150 |

TABLE 2

| | Average Grain Size | Dispersion Method | Number of Scratches |
|---|---|---|---|
| Example 1 | 10 μm | Mortar | 0.14/IC |
| Example 2 | 5 μm | Mortar | 0.1/IC |
| Comparison 1 | 15 μm | Roller | 34.1/IC |

INVENTIVE EXAMPLE 2

This inventive example is identical with Inventive Example 1 differing only in that the granular silica having an average grain size of 5 μm was used as the filler. The number of scratches formed on the surfaces of each drive IC's in this embodiment is shown in Table 2.

COMPARATIVE EXAMPLE 1

This comparative example is identical with Inventive Example 1 differing only in that the granular silica having an average grain diameter of 15 μm was used as the filler, and that the roller dispersion method was used for dispersing the filler in the resin material. The number of scratches formed on the surfaces of each drive IC's in this comparative example is shown in Table 2

As is clear from Table 2, even if epoxy resin which has a high thermal-shrinking ratio at the time of hardening is used as the resin component, the number of scratches per drive IC is extremely small in Inventive Example 1 and Inventive Example 2 in which granular silica having respective average grain sizes of 5 μm and 10 μm were used as the filler. On the other hand, in Comparative Example 1 in which granular silica having an average grain size of 15 μm was used as the filler and the roller dispersion method was used for dispersing the filler in the resin material, the number of scratches per drive IC is extremely large. As has been demonstrated, if the average grain diameter of the filler dispersed in the resin material is not greater than 10 μm, the damage to the drive IC's is remarkably reduced even if the drive IC's are protected by using a resin material which contains a resin component having a large shrinking rate at the time of hardening.

What is claimed is:

1. A thermal printhead comprising:

a substrate, a plurality of heating elements formed on the substrate, at least one drive IC for driving the heating elements, and a sealing portion for sealing the drive IC;

wherein the sealing portion contains a resin material and a granular filler having an average grain size not greater than 10 μm.

2. The thermal printhead according to claim 1, wherein the average grain size of the granular filler is not greater than 5 μm.

3. The thermal printhead according to claim 1, wherein the grains of the filler are rounded.

4. The thermal printhead according to claim 1, wherein the filler is selected from the group consisting of silica, alumina, zinc oxide, calcium carbonate, glass, kaolin, and clay.

5. The thermal printhead according to claim 1, wherein the resin material comprises a thermosetting resin.

6. The thermal printhead according to claim 5, wherein the thermosetting resin is selected from the group consisting of epoxy resin, polyimide resin, melamine resin, silicone resin, and phenolic resin.

7. The thermal printhead according to claim 5, wherein the resin material further contains a hardening agent.

8. The thermal printhead according to claim 1, wherein the resin material includes a photo-setting resin.

9. A method of sealing a drive IC with resin, comprising:

a mixing step for preparing a composite resin material by mixing a granular filler having an average grain size of not greater than 10 μm with a resin material;

an applying step for applying the composite resin material onto a substrate of a thermal printhead so as to cover a drive IC mounted on the substrate; and a hardening step for hardening the composite resin material by heating.

10. The method according to claim 9, wherein the grains of the filler are entirely rounded by a heating treatment performed before the mixing step.

11. The method according to claim 9, wherein the grains of the filler are rounded by a chemical treatment performed before the mixing step.

12. The method according to claim 9, wherein the mixing step utilizes a mortar-type mixing machine for dispersing the filler.

13. The method according to claim 9, wherein the average grain size of the granular filler is not greater than 5 μm.

14. The method according to claim 9, wherein the filler is selected from the group consisting of silica, alumina, zinc oxide, calcium carbonate, glass, kaolin, and clay.

15. The method according to claim 9, wherein the resin material comprises a thermosetting resin.

16. The method according to claim 9, wherein the thermosetting resin is selected from the group consisting of epoxy resin, polyimide resin, melamine resin, silicone resin, and phenolic resin.

* * * * *